United States Patent [19]

Mortimer

[11] Patent Number: 4,745,620

[45] Date of Patent: May 17, 1988

[54] APPARATUS AND METHOD FOR MAINTAINING CONSTANT MOLTEN METAL LEVEL IN METAL CASTING

[75] Inventor: John H. Mortimer, Medford, N.J.

[73] Assignee: Inductotherm Corporation, Rancocas, N.J.

[21] Appl. No.: 932,063

[22] Filed: Nov. 18, 1986

Related U.S. Application Data

[62] Division of Ser. No. 848,675, Apr. 4, 1986, Pat. No. 4,673,025.

[51] Int. Cl.[4] ..... H05B 6/22; B22D 27/02

[52] U.S. Cl. ..... 373/152; 373/156; 164/513

[58] Field of Search ..... 164/513, 493; 373/138, 373/151-153, 155, 156

[56] References Cited

U.S. PATENT DOCUMENTS

| | | | |
|---|---|---|---|
| 1,983,242 | 12/1934 | Rohn | 373/152 |
| 2,402,582 | 6/1946 | Scaff | 373/138 |
| 2,686,212 | 8/1954 | Horn et al. | 373/156 |
| 3,233,977 | 2/1966 | Coleman et al. | 373/156 |
| 3,818,971 | 6/1974 | Schutz | 164/4 |
| 3,842,894 | 10/1974 | Southworth et al. | 164/4 |
| 3,856,183 | 12/1974 | Bauer | 222/70 |
| 3,863,706 | 2/1975 | Chandley et al. | 164/255 |
| 3,875,322 | 4/1975 | Sundberg | 373/156 |
| 3,900,064 | 8/1975 | Chandley et al. | 164/51 |
| 3,944,715 | 3/1976 | Hegewaldt et al. | 373/153 |
| 4,060,692 | 11/1977 | Naastepad et al. | 373/156 |
| 4,112,997 | 9/1978 | Chandley | 164/119 |
| 4,340,108 | 7/1982 | Chandley et al. | 164/63 |

FOREIGN PATENT DOCUMENTS

| | | | |
|---|---|---|---|
| 157377 | 10/1985 | European Pat. Off. | 164/457 |
| 610530 | 3/1935 | Fed. Rep. of Germany | 373/151 |
| 3532763 | 3/1986 | Fed. Rep. of Germany. | |
| 43401 | 1/1934 | France | 373/156 |
| 412522 | 2/1966 | Japan | 164/119 |
| 9575 | 1/1982 | Japan | 164/155 |
| 1060 | 1/1984 | Japan | 164/457 |
| 144564 | 8/1984 | Japan | 164/255 |
| 223148 | 12/1984 | Japan | 164/493 |
| 616507 | 6/1978 | U.S.S.R. | 373/156 |

*Primary Examiner*—Nicholas P. Godici
*Assistant Examiner*—Samuel M. Heinrich
*Attorney, Agent, or Firm*—Seidel, Gonda, Goldhammer & Abbott

[57] ABSTRACT

Apparatus and method for providing a constant level of molten metal to a mold in gas permeable shell mold casting. The apparatus includes a furnace for melting and Holding metal to be cast. Structure is provided for locating a mold to be filled in casting relationship with the molten metal in the furnace and for causing molten metal to be drawn from the furnace into the mold. Structure responsive to the sensor is provided for tilting the furnace relative to the mold causing the level of the molten metal to remain constant relative to the mold as the mold is being filled.

3 Claims, 4 Drawing Sheets

APPARATUS AND METHOD FOR MAINTAINING CONSTANT MOLTEN METAL LEVEL IN METAL CASTING

This is a divisional of co-pending application Ser. No. 848,675 filed on Apr. 4, 1986, now U.S. Pat. No. 4,673,025.

BACKGROUND OF THE INVENTION

This invention relates to metal casting apparatus and methods which employ gas permeable shell molds.

Gas permeable shell mold casting for casting of metal in an evacuated/inert gas atmoshere is known and is disclosed in U.S. Pat. Nos. 3,863,706; 3,900,064; 4,112,997; and 4,340,108. Gas permeable shell mold casting was developed to permit precision casting, on a high production basis, of metals which must be cast in an evacuated or inert gas atmosphere. Prior to the development of gas permeable shell mold casting, precision casting of metals in an evacuated or inert gas atmosphere presented a number of problems. In part, those problems were due to the time necessary to establish the required seals and to evacuate the casting apparatus, especially insofar as the relatively large melting and pouring chamber was concerned. There were also problems caused by the inclusion in the cast parts of dross or other impurities present on the surface of the molten metal.

Although gas permeable shell mold casting solved many of the problems of casting metals in an evacuated or inert gas atmoshere, problems still remain. The most critical problem is in providing a constant level of molten metal to the mold. Until the present invention, this problem has remained largely unsolved.

It is therefore an object of the invention to provide an apparatus and method for providing a constant level of molten metal to a mold in gas permeable shell mold casting which is simple, effective and reliable. Other objectives and advantages of the invention will become apparent hereinbelow.

SUMMARY OF THE INVENTION

The present invention is an apparatus for providing a constant level of molten metal to a mold in gas permeable shell mold casting. The apparatus comprises furnace means for melting and holding metal to be cast, means for locating a mold to be filled in casting relationship with the molten metal in the furnace means, and means for causing molten metal to be drawn from the furnace means into the mold. Sensor means are provided for sensing the change in the level of the molten metal in the furnace means relative to the mold as molten metal is drawn into the mold. Means responsive to the sensor means are provided for tilting the furnace means relative to the mold for causing the level of the molten metal to remain constant relative to the mold as the mold is being filled.

The present invention includes a method of providing a constant level of molten metal to a mold in gas permeable shell mold casting, and comprises the steps of melting and holding metal to be cast in a furnace means, locating a mold to be filled in casting relationship with the molten metal in the furnace means, causing molten metal to be drawn from the furnace means into the mold, sensing the change in the level of the molten metal in the furnace means relative to the mold as molten metal is drawn into the mold, and tilting the furnace means relative to the mold in response to change in the level of the molten metal relative to the mold to cause the level of the molten metal to remain constant relative to the mold as the mold is being filled.

DESCRIPTION OF THE DRAWINGS

For the purpose of illustrating the invention, there is shown in the drawings a form which is presently preferred; it being understood, however, that this invention is not limited to the precise arrangement and instrumentalities shown.

DESCRIPTION OF THE INVENTION

Figure 1:
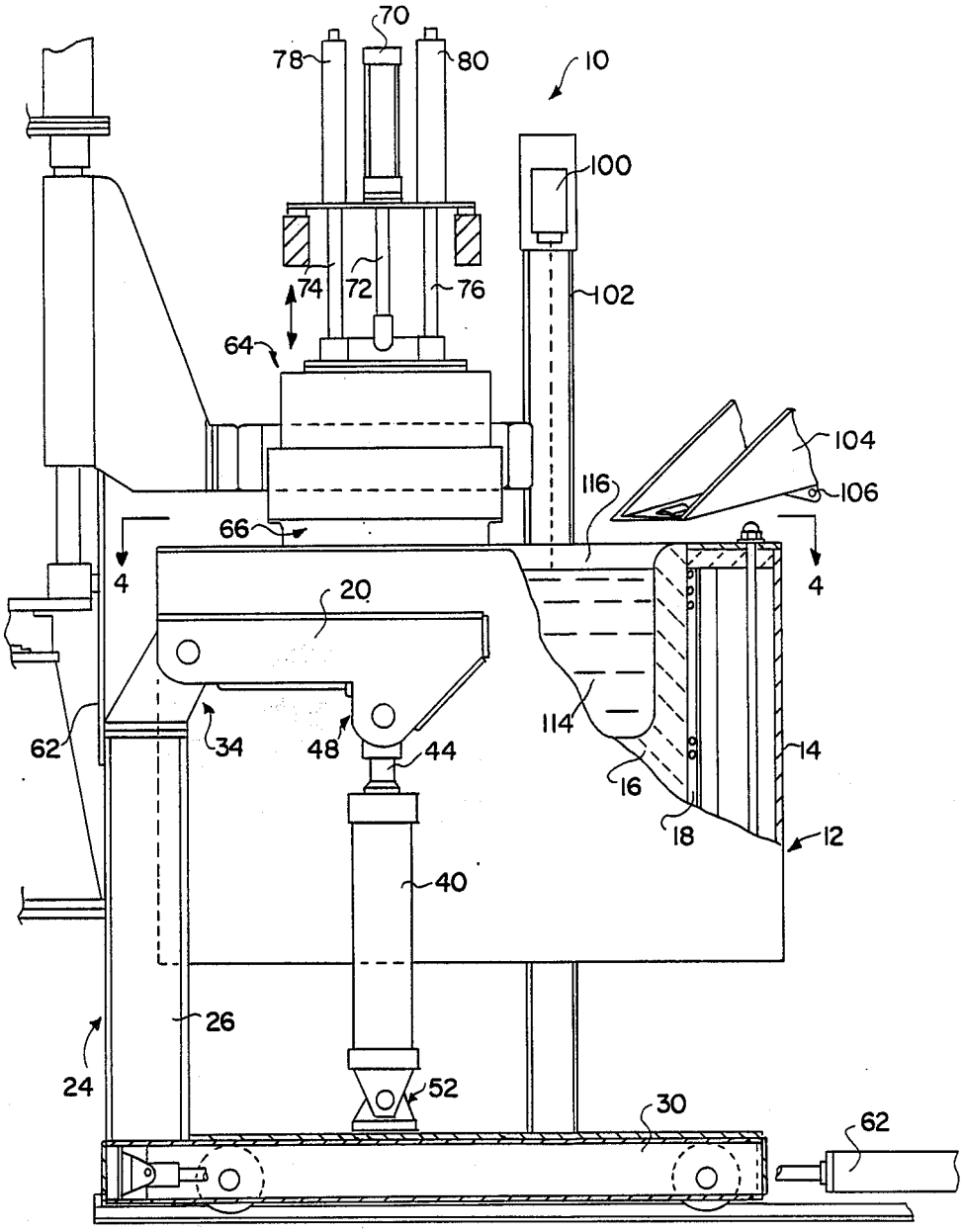
FIG. 1 is a simplified elevational view of apparatus in accordance with the present invention.

Referring now to the drawings, wherein like numerals indicate like elements, there is shown in FIG. 1 a casting machine 10 equipped with the apparatus of the present invention. The casting machine 10 includes a furnace 12 for melting and holding metal to be cast. As will be understood by those skilled in the art, furnace 12 comprises a housing or shell 14 and a crucible 16 constructed of a suitable refractory material, such as a high temperature ceramic, within the shell 14. Furnace 12 is provided with a plurality of induction coils 18 surrounding crucible 16 and through which high frequency electric current is passed to inductively heat and melt the metal to be cast. Induction coils 18 are connected to a suitable source of electrical power (not shown in FIG. 1) in known manner.

Figure 4:
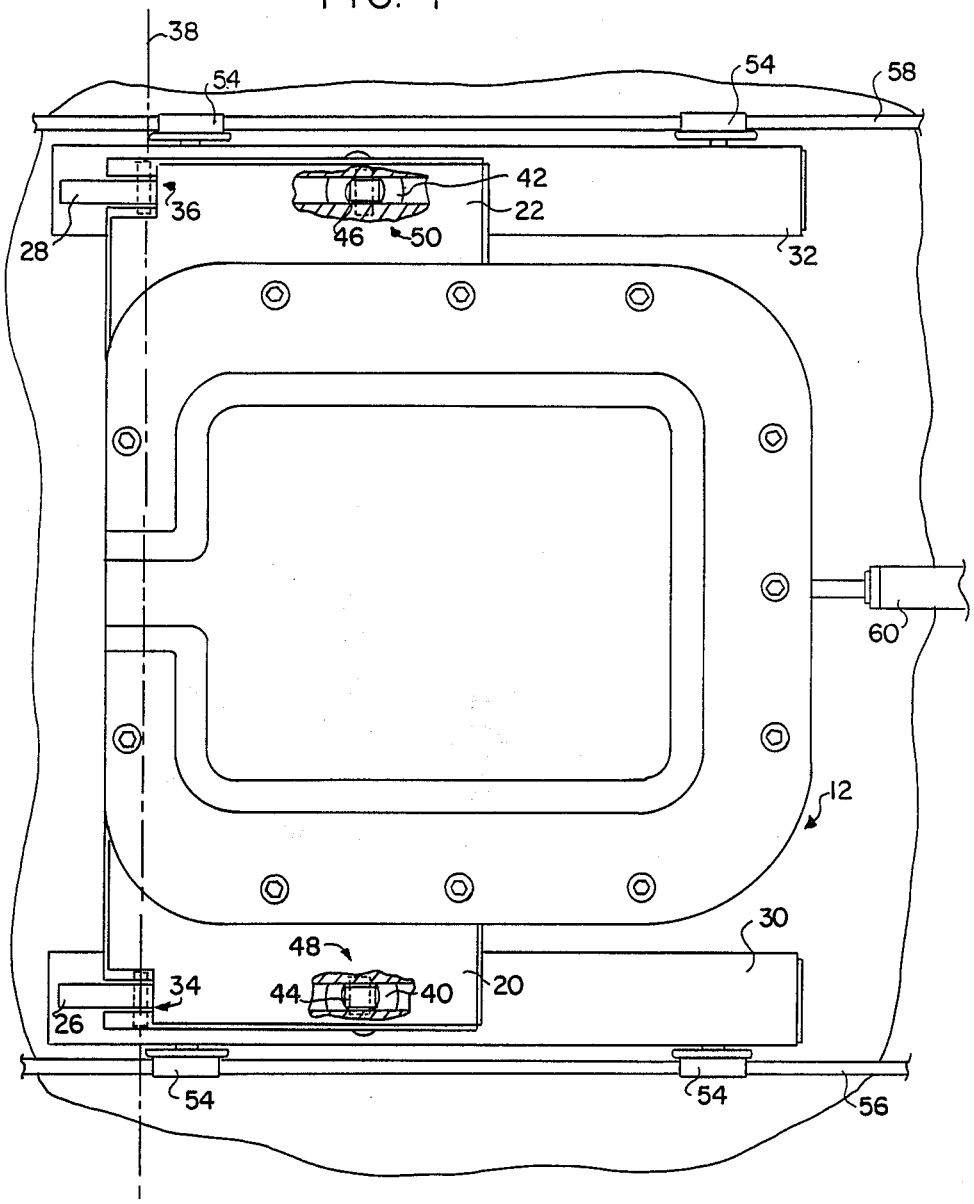
FIG. 4 is a top plan view of a portion of the apparatus shown in FIG. 1, taken along the lines 4—4.

As best seen in FIGS. 1 and 4, furnace 12 includes a pair of arms 20 and 22 on opposite side of the furnace by means of which furnace 12 may be mounted to a support structure or frame 24. Frame 24 comprises a pair of upright standards 26 and 28 which are mounted on horizontal support members 30 and 32. Arms 20 and 22, which are fixed to furnace 12, are pivotably mounted to standards 26 and 28 as shown at locations 34 and 36. Pivot locations 34 and 36 may have any suitable structure for providing a pivotable connection between arms 20 and 22 and standards 26 and 28. A pivot axis 38 about which furnace 12 may tilt, as will be described in greater detail below, is defined through pivot locations 34 and 36, as best seen in FIG. 4. The ends of arms 20 and 22 opposite pivot locations 34 and 36 are connected to cylinders 40 and 42, respectively. Cylinders 40 and 42 may be pneumatic or hydraulic, and include extensible/retractable cylinder rods 44 and 46, respectively. Rods 44 and 46 are extensible and retractable by cylinders 40 and 42 in known manner, and have their free ends pivotably connected to arms 20 and 22 at pivot locations 48 and 50, respectively. The opposite end of cylinders 40 and 42 are pivotably connected to base 30, as at location 52 in FIG. 1. Cylinders 40 and 42 may be connected to a source of pneumatic or hyraulic fluid by suitable valving and connections, in known manner.

Horizontal support members 30 and 32 may be provided with wheels 54 and mounted on track members 56 and 58 so that furnace 12 can be moved left to right with respect to casting machine 10 in FIG. 1. Movement of furnace 12 can be accomplished by cylinder 60, as will be understood by those skilled in the art. A stop member 62 may be provided on casting machine 10 to limit movement of furnace 12 to the left (as viewed in FIG. 1) and to properly position furnace 12 with respect to casting machine 10.

As best seen in FIG. 1, casting machine also includes a head 64 in which may be located a gas permeable shell mold 66. Gas permeable shell molds are well known in the art, and need not be described in detail here. Head 64 is connected by a vacuum line (not shown) to a vacuum pump (not shown), by means of which a vacuum may be drawn on mold 66 so that molten metal may be drawn into the mold, in known manner. Head 64 and mold 66 may be moved vertically toward and away from furnace 12 by means of cylinder 70 and rod 72, in known manner. Guide rods 74 and 76 are provided in tubular guides 78 and 80 so that head 64 and mold 66 can be moved straight up and down and will not be skewed when head 64 and mold 66 are raised or lowered.

Next to head 64 is mounted a remote level sensor 100. Level sensor 100 may be mounted on a standard 102 which is fixed with respect to casting machine 10. Level sensor 100 may be any suitable remote level sensor, such as a laser level sensor, familiar to those skilled in the art. Standard 102 and level sensor 100 are located so that the level sensor has a clear line of sight to the level of molten metal in the furnace, unobstructed either by head 64 or the edge of the furnace when the furnace is tilted.

Casting machine 10 may also be supplied with a suitable charge system for adding metal to be melted to furnace 12. Alternatively, liquid metal may be added directly. Any suitable charge system, such as a conveyor system, may be employed. Charge for furnace 12 is directed into crucible 16 via a chute 104. Chute 104 may be pivoted as at location 106, so that chute 104 may pivot out of the way to allow for tilting of furnace 12.

Figure 2:
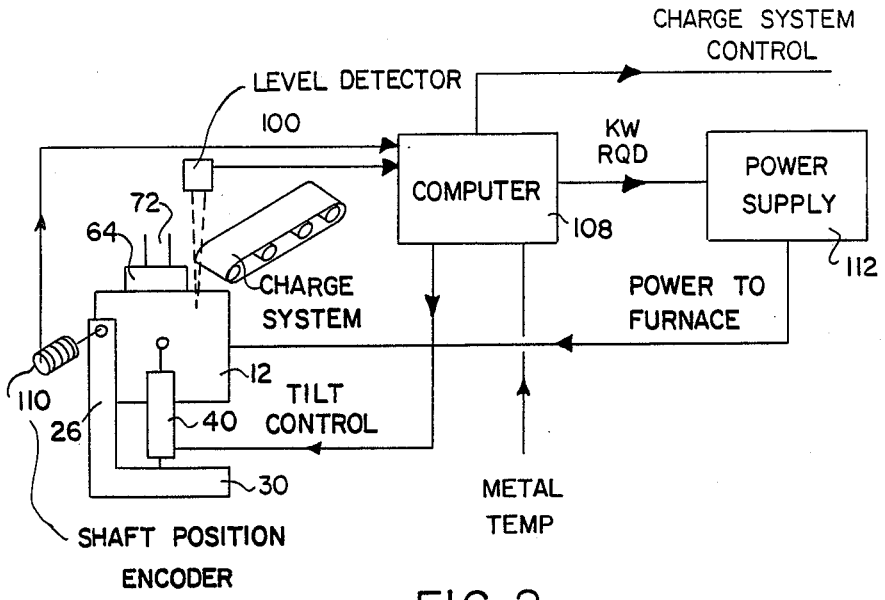
FIG. 2 is a simplified block diagram of the present invention.

The apparatus of the invention is shown schematically in FIG. 2. The central controller for the invention is computer 108, which may be a mini-computer or dedicated microprocessor suitably programmed to carry out the operations of the invention. As inputs, computer 108 receives the output signal from level detector 100 and the output of a shaft position encoder 110, which is not shown in FIGS. 1 or 4, but which may be mounted on furnace 12 along pivot axis 38 to sense the angle through which furnace 12 is tilted. Shaft encoders for sensing angular position are well known, and need not be described in detail here.

An additional input to computer 108 is a signal from a temperature sensor which senses the temperature of the metal in the furnace. Temperature of the molten metal may be sensed by any suitable means, such as a contact probe or infrared pyrometer. This measurement may be made separately and the results inputted to computer 108 by a conventional keyboard (not shown).

In response to the inputs, computer 108 generates a number of control outputs for the apparatus. One output is a control signal to the furnace power supply 112 to control the power being supplied to induction coils 18 of furnace 12. Computer 108 controls power supply 112 so that a predetermined temperature of the molten metal in the furnace may be maintained, and so that additional power may be supplied to furnace 12 for melting when furnace 12 is charged with cold metal. The way in which computer 108 may control power supply 112 for these functions will be well understood by those skilled in the art, and need not be described here in detail.

Computer 108 also processes the signals from level sensor 100 and shaft encoder 110 and generates a tilt control output, which is used to control the operation of cylinder 40.

The mode of operation of the invention is now described.

After furnace 12 has been charged with and melted the metal to be cast, or has been charged with liquid metal, head 64 and mold 66 are lowered into furnace 12 so that mold 66 is partially immersed in the molten metal 114. A vacuum is then drawn on mold 66 to draw molten metal into the mold.

Figure 3:
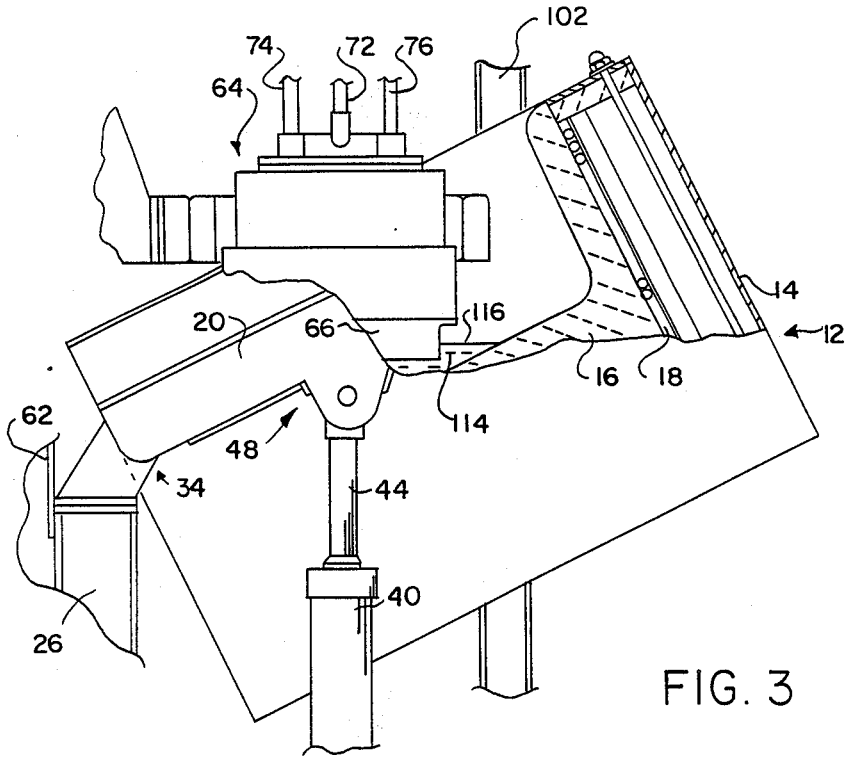
FIG. 3 is a partial sectional view of the apparatus of FIG. 1, showing the furnace means in a tilted position relative to the mold.

Level sensor 100 continuously monitors the level 116 of molten metal 114 relative to mold 66. It will be appreciated that, as molten metal is drawn up into mold 66, level 116 will drop. The change in level 116 is sensed by level sensor 100, and a signal representative of the change in level 116 is sent to computer 108. Computer 108 processes this signal and generates a tilt control signal which, through appropriate hyraulic or pneumatic lines and valving causes cylinder 40 to extend shaft 44. As shaft 44 is extended, furnace 12 tilts about pivot axis 38. See FIG. 3. Tilting furnace 12 in effect raises the level 116 of molten metal 114 with respect to mold 66. Computer 108 may be programmed to continuously tilt furnace 12 as molten metal is drawn up into mold 66, with the effect that the level 116 of molten metal 114 remains constant with respect to mold 66.

When the mold 66 is full, it is withdrawn from furnace 12, and casting machine 10 sends a signal to computer 108 that the casting operation is complete. When the casting operation is complete, head 64 and mold 66 are raised out of furnace 12, a new mold is placed in head 64, and the process repeated.

Computer 108 may be programmed to control the operation of the charge system so that additional charge may be added to furnace 12 to continually replenish the metal being drawn into mold 66. The shaft position encoder signal is processed by computer 108 to determine whether the angle of tilt of furnace 12 is sufficiently large that more metal should be added. If so, computer 108 activates the charge system, charging additional metal into the furnace. The computer 108 will maintain level 116 constant as metal is charged into the furnace by reducing the angle of tilt of the furnace. The change in angle of tilt of the furnace is continuously sensed by shaft position encoder 110. When the shaft position encoder senses that furnace 12 has returned to its original horizontal position, computer 108 terminates the charging operation. The computer 108 calculates the total charge being placed in the furnace by the change in angle of tilt, and signals power supply 112 to maintain an average power level in furnace 12 so that cold metal can be melted and temperature stability is maintained.

Computer 108 may be prorammed to stop the tilting of furnace 12 after furnace 12 has been tilted for a preselected number of degrees. When furnace 12 has been tilted to the preselected number of degrees, as indicated by shaft position encoder 110, computer 108 will stop the tilting of furnace 12, and reverse the drive to cylinder 40. Cylinder 40 will then retract rod 44, allowing furnace 12 to be tilted back to its original horizontal position.

Alternatively, the change in level 116 sensed by level sensor 100 may be processed to generate a signal representative of the change in level 116. This signal is sent to computer 108, which processes this signal and generates a lift control signal that controls the vertical position of mold 66 relative to level 116 of liquid metal 114. In this alternate form of the invention, furnace 12 remains in a horizontal position and no tilting takes place. Instead, as level 116 falls as metal is drawn into mold 66, the mold is lowered to keep level 116 constant relative to mold 66. When the level 116 falls below a predetermined value, level control 100 sends a signal to computer 108 and either solid or liquid metal is added to the furnace.

The furnace 12 needs to have a very large surface area to accomodate mold 66. However, for holding of metal, especially ductile iron, for example, it is important to have the minimum quantity of metal on hand at the casting station. This is because changes in metallurgy of the molten metal can occur over time which affect the quality of the end casting. The longer the "dwell time" of the molten metal in furnace 12, the greater the changes in metallurgy will be. To minimize "dwell time", a very small depth of metal is preferred in this casting process.

Figure 5:
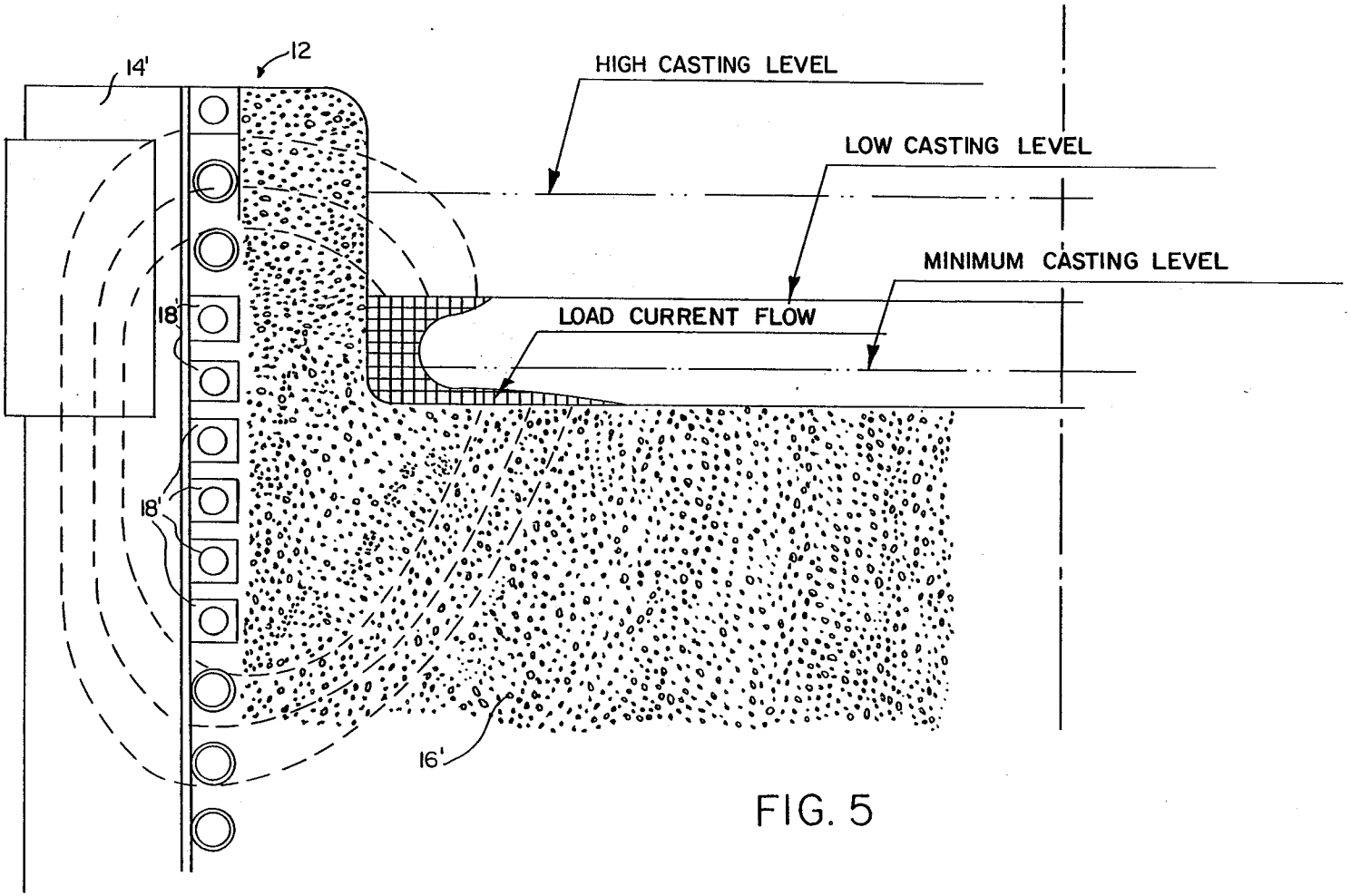
FIG. 5 is a partial sectional view of a novel furnace construction especially useful in connection with the present invention.

A furnace construction which makes possible the efficient melting and/or holding of small depths of metal is shown in FIG. 5. For ease of correlating the various parts of the furnace of FIG. 5 to the other drawings, primed reference numerals are used. Furnace 12' in FIG. 5 comprises a furnace shell 14' within which is a crucible 16'. As shown in FIG. 5, the interior of crucible 16' is very shallow. Surrounding crucible 16' within shell 14' are induction coils 18'.

Normally in a coreless furness, the load length and coil length are equal. However, it is well known that a coreless furnace is inefficient when the load and coil length are short in comparison to the load and coil diameter, as is required here to maintain a very small depth of molten metal. Accordingly, in the novel furnace according to the present invention, the coil length is made much longer than the load. So as not to allow stray flux to heat the mold surroundings, the minimum metal level is held to the top of the induction coil. Thus, the induction coil 18' extends far below the metal. The bottom turns of the coil 18' couple magnetically to the bottom of the molten metal and, thus, act as if both the load and coil were very much longer than the load depth. Thus, small load depths can be made to act as if they were equal to the much larger depth shown by the induction coil with similar electrical characteristics and efficiencies. Coil to load depth ratios of 1 to 1 or more can be achieved, with higher ratios yielding higher efficiencies. Preliminary calculations show that extension of the coils 18' of three times the load depth produce optimum efficiencies. Thus, it is believed that optimum results are achieved at a ratio of 4 to 1.

The furnace of FIG. 5 thus enables very small depths of metal to be melted and/or held at very high efficiencies, which in turn allows "dwell time" and changes in metallurgy to be minimized.

The present invention may be embodied in other specific forms without departing from the spirit or essential attributes thereof and, accordingly, reference should be made to the appended claims, rather than to the foregoing specification, as indicating the scope of the invention.

I claim:

1. A coreless induction furnace comprising a shell, a non-conductive crucible within the shell, the crucible having an interior cavity whose depth is substantially smaller than the lateral dimensions of the crucible, and an induction coil within the shell and surrounding the crucible, said coil being in fixed relationship with the crucible and surrounding at least a lower portion of the interior cavity , the length of said coil being at least two times greater than the depth of the crucible and less than the diameter of the coil.

2. A furnace according to claim 1, wherein the coil surrounds at least a lower portion of the interior cavity for a preselected distance and extends below the interior cavity.

3. A coreless induction furnace comprising:

a shell, a non-conductive crucible within the shell, the crucible having an interior cavity whose depth is substantially less than the lateral dimensions of the crucible, and an induction coil within the shell and surrounding the crucible, the coil being in fixed relationship with the crucible and extending for a preselected distance below the interior cavity and having a diameter greater than the length of the coil.

* * * * *